US005314717A

United States Patent [19]

Alt

[11] Patent Number: 5,314,717

[45] Date of Patent: May 24, 1994

[54] PROCESS AND APPARATUS FOR COATING MOTOR PISTONS

[76] Inventor: Peter Alt, Rindelbacher Strasse 38, D-7090 Ellwangen/Jagst, Fed. Rep. of Germany

[21] Appl. No.: 728,495

[22] Filed: Jul. 11, 1991

[30] Foreign Application Priority Data

Jul. 20, 1990 [DE] Fed. Rep. of Germany ..... 4023135

[51] Int. Cl.[5] ..... B05D 1/32; B05D 5/00

[52] U.S. Cl. ..... 427/282; 92/223; 118/406; 123/193.6

[58] Field of Search ..... 427/282; 118/406; 92/223; 123/193.6

[56] References Cited

U.S. PATENT DOCUMENTS 4,873,951 10/1989 Garthwaite ..... 123/196
4,899,702 2/1990 Sasaki et al. ..... 123/193 P

FOREIGN PATENT DOCUMENTS 3338549 3/1984 Fed. Rep. of Germany .
1193068 8/1989 Japan .

*Primary Examiner*—Michael Lusignan
*Attorney, Agent, or Firm*—Jenner & Block

[57] ABSTRACT

The coating of the cylindrical periphery of engine pistons with coating compound, in particular low friction materials, is performed by means of screen printing. The pistons can be coated in the vertical position around their vertical central longitudinal axis as they rotate past a screen printing stencil.

17 Claims, 3 Drawing Sheets

PROCESS AND APPARATUS FOR COATING MOTOR PISTONS

FIELD OF THE INVENTION

The invention relates to a process and an apparatus for coating the cylindrical surface of engine pistons or the like with a coating compound, in particular low friction materials.

BACKGROUND OF THE INVENTION

Coating of piston surfaces with lead, tin, graphite or similar coatings having a predetermined thickness used to prevent the seizing of the pistons in the event of a failure in oil lubrication in the cylinders of an internal combustion engine and also in some cases to reduce engine knocking. The coating is applied in varying thicknesses and with varying coating patterns to achieve the desired results.

Hitherto the coating of engine pistons has generally been applied by spraying, which is expensive and unsatisfactory because of high losses and low efficiency. Furthermore, spraying is detrimental to the environment as large quantities of solvents are atomized.

Since the peripheral surfaces of the pistons are coated using masks when spraying, sharp contours of the piston surfaces cannot be reached. In addition, the spray mist causes undefinable coating contours under spraying masks which are not close together. Furthermore, the thickness of the coating, which is determined by adjusting the spray nozzle, normally has large tolerances.

SUMMARY OF THE INVENTION

An object of the invention is therefore to create a process and an apparatus for coating the cylindrical periphery of engine pistons or the like with a coating compound without the above-mentioned deficiencies and with a relatively simple process and structure. It should also be possible to produce the desired coating thickness based on predetermined values at any time for different pistons.

This object is achieved by the invention by applying a coating by means of a screen printing process.

With this screen printing process a uniform coating with minimum tolerances can be consistently applied to the cylindrical peripheral surfaces of engine pistons or the like, with environmentally damaging emission, such as, for example, solvent evaporation, being completely eliminated. With this process it is also possible to apply several layers of coating with the same or different thicknesses on top of one another in one process sequence. If the viscosity of the coating compound remains constant, the thickness of the coating on the peripheral surface of the piston can be predetermined via the characteristics of the woven cloth of a screen printing stencil used in the process.

With the process specified by the invention one or several coating-free areas can also advantageously be provided in a coated surface for lubrication bore reliefs and/or as observation ports in the form of slits, holes, recesses, strips or such configurations. Such free areas perform a double function. Firstly, they serve as measurement holes or observation ports for the measurement and consequently the monitoring of the coating thickness and secondly they improve the lubrication of the piston in normal operation, as they act as grease bearings. In contrast to known spraying methods, in the screen printing process specified by the invention, such free areas can simply and without great expenditure be produced in any size and form with very precise thickness and edge contours. This is the case especially for very small coating free areas.

With the process specified by the invention the pistons are expediently coated in an upright position and around their vertical central longitudinal axis while they rotate past a printing stencil while abutting the stencil, as the screen printing stencil is also moved in the direction of rotation of the peripheral surface of the piston.

Of course, it is also possible to place the pistons in a horizontal position during coating as, for example, in experiments and with small loads.

The coating can also be advantageously applied in a wedge shape with the coating thickness decreasing at its lateral and/or upper and lower edges. As a result of this method, hard edges or steps are avoided and the coated surface is smoother. In this way a better adaptation to the rounded shape of the piston is achieved with a correspondingly reduction in friction. This is true in particular for the lateral edges, but this is also advantageous for the upper and lower edge with respect to the direction of movement of the piston. The coating compound can be brought to the screen printing stencil of the screen printing unit while it is continually rotated and mixed together.

The invention also relates to an apparatus for performing the screen printing coating process, which is characterized in that it comprises one or more screen printing stations each having a screen printing stencil and an applicator blade. The screen printing stencil with which the pistons are to be coated can be moved with the piston's cylindrical peripheral surface to be coated. The pistons, contained in receptacles, can be rotated around their central longitudinal axes, with the printing stencil tangentially aligned thereto and without slipping in the direction of rotation of the peripheral surface of the piston. In addition, an applicator blade with its blade edge extending parallel to the central longitudinal axis of the piston to be coated is positioned opposite the peripheral surface of the piston abutting the screen printing stencil during the printing operation. Alternatively, the pistons can be positioned so that they are upright or lying horizontally.

In one configuration the screen printing stencil and the applicator blade extend vertically and the pistons are disposed vertically in the receptacles.

The hardness of the blades can also be adapted to the required thickness of the coating to be applied. If there are several screen printing stations located one behind the other in the path of the pistons to be coated, the blades of these stations can have the same or different hardness depending upon the application.

DETAILED DESCRIPTION OF THE INVENTION

Figure 1:
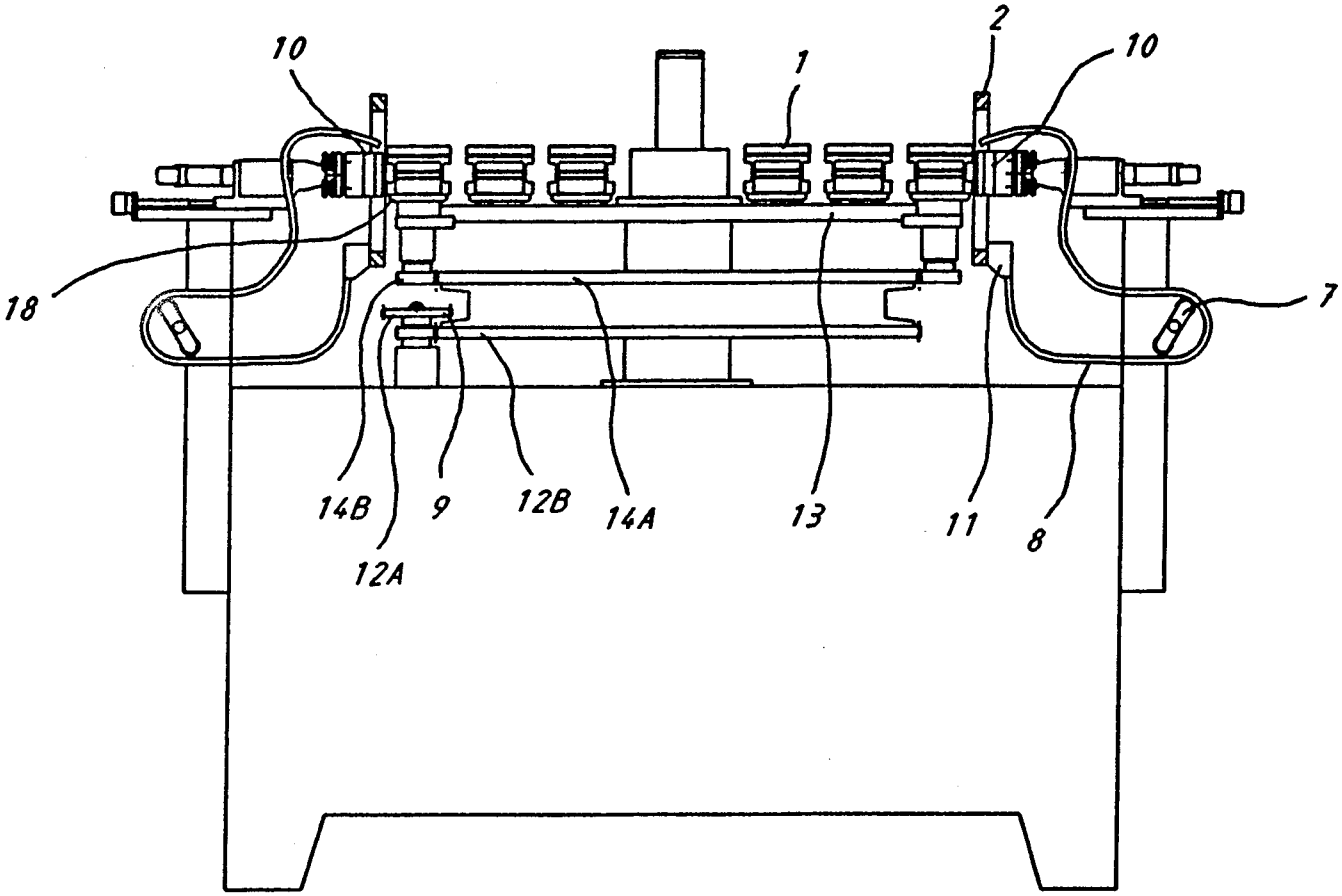
FIG. 1 provides a side view of a coating device.
Figure 2:
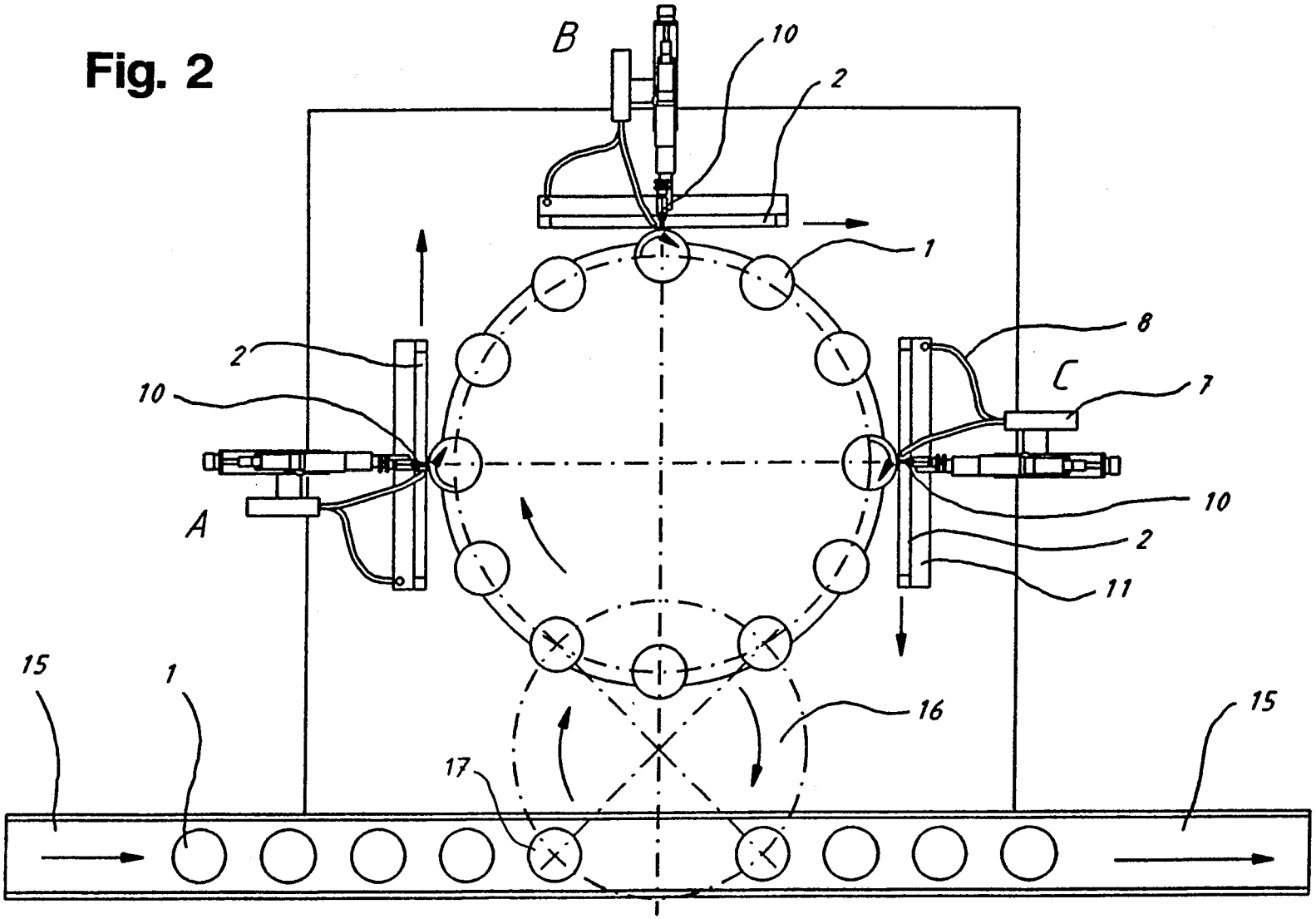
FIG. 2 provides a plan view of the coating device shown in FIG. 1.

In the preferred embodiment represented in the drawings, the pistons are supplied by a continuously rotating conveyor belt 15 with their central longitudinal axis X vertical then are sequentially removed from the conveyor belt by a rotating head 16 having tongs 17, which grasp the pistons 1 in their grooves with jaws (not shown), and are transferred parallel to one another via a epicyclic gear system 9, 12A, 12B, 14A, 14B to position controlled receptacles 18, which are disposed on a rotary table 13. The pistons 1 are held in these receptacles 18 so that they cannot rotate by upwardly projecting pins 6, on to which the pistons 1 are placed, and by rotating the rotating table 13 they are brought up one after the other by a step device to three screen printing stations A, B and C positioned behind one another in the path of the pistons, in which stations they receive the predetermined coating Al, B1, Cl on their cylindrical surface one after the other. The coatings are applied by means of screen printing stencils 2, which by means of applicator blades 10 come to tangentially abut the peripheral surface of the pistons to be coated. During the printing operation the pistons together with their receptacles 18 rotate around their central longitudinal axis X (FIGS. 3 and 5), in which the printing stencil 2 can be aligned, without slipping, in the direction of rotation of the peripheral surface of the pistons tangentially thereto. The arrows in FIG. 2 shows the direction of rotation and direction of movement of the peripheral surface of the pistons and of the screen printing stencil 2 during the printing operation. During this operation the applicator blade remains with its blade edge extending parallel to the central longitudinal axis X of the piston 1 to be coated opposite the peripheral surface of the piston abutting the screen printing stencil and at the same time the coating compound is supplied to the upper region of the screen printing stencil via a hose line 8 and applied through the stencil to the peripheral surface of the pistons by applicator blades 10.

Just one part of the peripheral surface of the piston can be coated, depending on the design of the screen printing stencil. In the exemplified embodiment shown in FIGS. 3 to 5, the head of the piston 1 is provided with a circular coating C3 by the screen printing station C and in the region of the periphery of the piston on the sides adjacent to the piston pin bore 3 with coatings for surfaces Al, B1, Cl by the coating stations A, B, C.

The coated surfaces shown in the exemplified embodiment are given as examples. In many cases fewer coated surfaces are adequate. Thus, for example, only two lower coated surfaces Al may be provided, which are located opposite one another and extend over a peripheral region of approximately 90° . The two coated surfaces Al may be provided as buffers, for example, for the reduction of engine knock and with a coating thickness of 10 μm.

Two coated surfaces Cl, which are also located opposite one another and are mutually spaced and disposed parallel to coated surfaces Al and also possibly the coated surfaces B1 may be provided in particular for emergency lubrication in the event of the failure of the engine's lubrication system. Coated surfaces Cl (and possibly B1) may also extend over a peripheral region of 90° and may have a thickness of 20 μm, for example.

Figure 5:
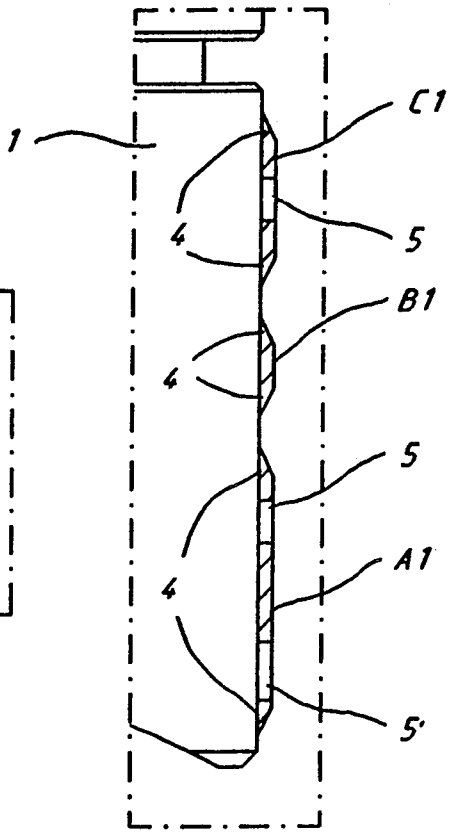
FIG. 5 is an enlarged view of a peripheral region of a piston with coating surfaces in lateral elevation.

As can be seen from FIG. 5, the coated surfaces Al, B1 and Cl form a wedge shape 4 at their edges.

Figure 4:
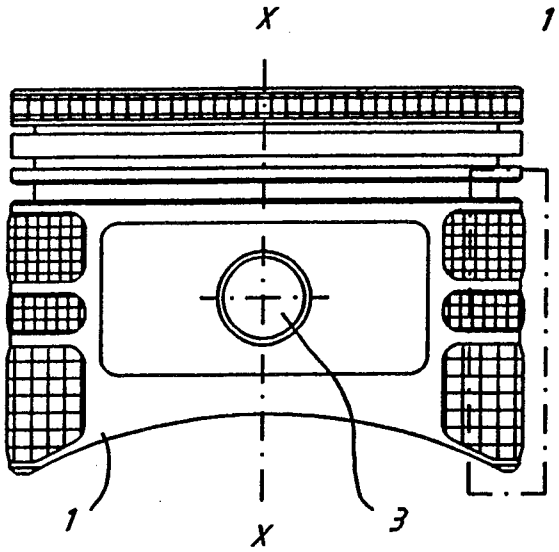
FIG. 4 provides a view of the exemplified embodiment shown in FIG. 3 in a position rotated by 90° thereto.
Figure 3:
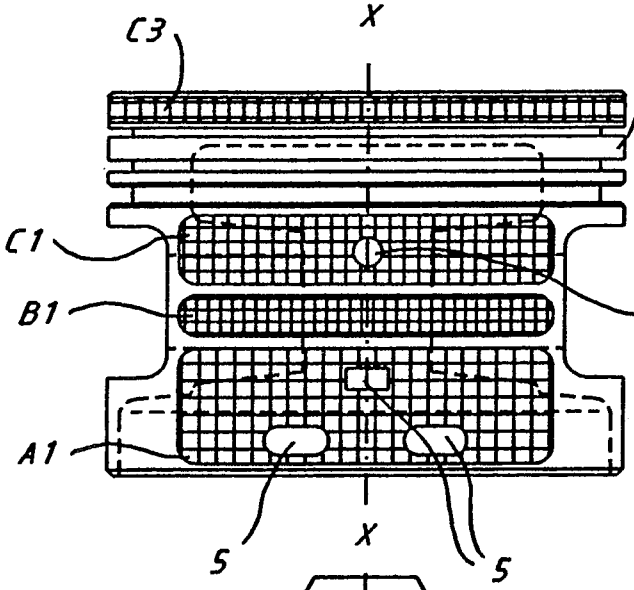
FIG. 3 provides a side view of a piston with an exemplified embodiment of the coating to be achieved with the process specified by the invention.
Figure 6:
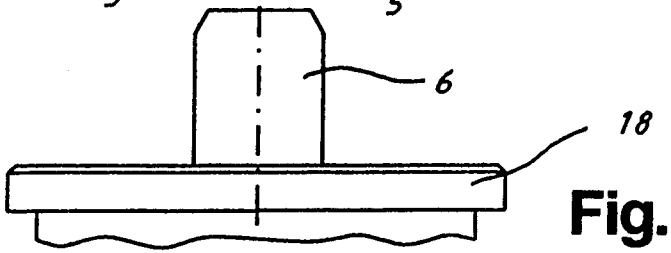
FIG. 6 provides a side view of a receptacle for a piston.

As shown in FIG. 3 and the enlarged representation in FIG. 4, the coated surfaces can be provided with small uncoated free areas 5. For this purpose rectangular, ellipsoidal and round recesses 5, for example, are provided in the coated surfaces Al and Cl. Of course further coated surfaces having corresponding coating free areas may be provided, for example, in the form of holes, slits, strips, ellipses, ovals, circles or similar shapes.

Graphite powder having a resinous binding agent or a resin is preferably used as the coating compound. The following proportions for the mixture have proved successful:

Graphite 30–50% by weight, preferably 40%

Resin 30–50% by weight, preferably 60%.

The viscosity of the coating compound should preferably be within a range from 6,000–8,500 cp. Very good results are achieved with a viscosity of approximately 7,000 cp.

To regulate or, if necessary, change the viscosity, the use of isopropanol or ethylglycol have proved successful.

Excess coating compound running off the screen printing stencil is collected in a storage vat 11 located under the stencil and is supplied by means of a pump 7 via a hose line 8 while being continually mixed back to the screen printing stencil. By mixing and continuous supplying the screen printing compound it is possible to prevent the tendency of the coating compound to change its viscosity by decomposition.

After the end of the coating application, the blade 10 is withdrawn from the screen printing stencil 2, and thus loses contact with the coated peripheral surface of the piston so that the screen printing stencil can be withdrawn from contact with the piston into its tangential initial position.

After the coating of the pistons has been effected in the three screen printing stations A, B and C, they are returned to the rotary head 16 and removed via the tongs 17 from the receptacles 18 and conveyed on the conveyor belt 15 to be transported to another location.

I claim:

1. A process for coating the cylindrical peripheral surface of engine pistons with a coating compound, comprising the steps of:

disposing a printing stencil to the cylindrical peripheral surface of a piston, and applying the coating compound through said printing stencil to print the coating compound on said peripheral cylindrical surfaces, such that one or more coated surfaces are printed on a portion of said peripheral cylindrical surface and one or more uncoated areas in the form of slits, holes, recesses or strips are encompassed within at least one of said coated surfaces.

2. A process according to claim 1, such that the pistons are printed in the vertical position and around their perpendicular central longitudinal axis or in the horizontal position as they rotate past said screen printing stencil.

3. A process according to claim 2, including moving the pistons individually to a screen printing unit which includes said stencil and in the region of said unit rotating said pistons around their central longitudinal axis, with said screen printing stencil of the screen printing unit aligned during the printing operation in a straight line without slipping while tangentially abutting the cylindrical peripheral surface of the piston, and using a blade in said screen printing unit to press the screen printing stencil against the cylindrical peripheral surface of the piston.

4. A process according to claim 1, wherein the process includes applying two or more coatings of different thicknesses one after the other at different positions on the cylindrical periphery of the piston in the same process sequence.

5. A process according to claim 1 wherein a mixture of graphite powder and a resin or a resinous binding agent is used as the coating compound.

6. A process according to claim 5, wherein the proportions for said mixture are between 30–50% by weight of a graphite powder and between 50 and 70% by weight of a binding agent.

7. A process according to claim 5, wherein said coating compound has a viscosity of from 6,000 to 8,500 cp, preferably approximately 7,000 cp.

8. A process according to claim 7, wherein isopropanol ethylglycol is included in the coating compound as a solvent.

9. A process according to claim 1, wherein the coating compound has approximately 10 μm thickness printed on a first portion of the piston surface to reduce engine knock and printed on a second portion of the piston surface having a thickness of approximately 20 μm for emergency lubrication.

10. A process according to claim 1, wherein the coating is printed in a wedge shape with the coating thickness decreasing at its lateral upper and lower edges.

11. A process according to claim 1, including sequentially supplying the pistons to said screen printing units by means of a stepping mechanism.

12. A process according to claim 1, wherein the coating compound is supplied to said screen printing stencil of the screen printing unit while the coating compound is continuously being rotated and mixed.

13. A process according to claim 6, wherein the proportions for said mixture is 40% by weight of said graphite powder.

14. A process according to claim 6, wherein the proportions for said mixture is 60% by weight of said binding agent.

15. A process for coating the cylindrical peripheral surface of engine pistons or the like with a coating compound, comprising the steps of: moving the pistons individually to a screen printing unit which includes printing stencils, moving said pistons past said screen printing stencil while said pistons rotate around their central longitudinal axis, with said screen printing stencils aligned during the printing operation in a straight line without slipping while tangentially abutting the cylindrical peripheral surface of the piston, using a blade in said screen printing unit to press the screen printing stencil against the cylindrical peripheral surface of the piston, and applying the coating compound through said printing stencil to print the coating compound on the pistons, wherein said coating compound has approximately 10 μm thickness printed on a first portion of the piston surface to reduce engine knock and printed on a second portion of the piston surface having a thickness of approximately 20 μm for emergency lubrication.

16. A process for coating the cylindrical peripheral surface of engine pistons or the like with a coating compound, comprising the steps of: moving the pistons individually to a screen printing unit which includes printing stencils, moving said pistons past said screen printing stencil while said pistons rotate around their central longitudinal axis, with said screen printing stencils aligned during the printing operation in a straight line without slipping while tangentially abutting the cylindrical peripheral surface of the piston, using a blade in said screen printing unit to press the screen printing stencil against the cylindrical peripheral surface of the piston, and applying the coating compound through said printing stencil to print the coating compound on the pistons, said coating being printed in a wedge shape with the coating thickness decreasing at its lateral and/or uppper and lower edges.

17. A process for coating the cylindrical peripheral surface of engine pistons or the like with a coating compound, comprising the steps of: moving the pistons individually to a screen printing unit which includes printing stencils, moving said pistons past said screen printing stencil while said pistons rotate around their central longitudinal axis, with said screen printing stencils aligned during the printing operation in a straight line without slipping while tangentially abutting the cylindrical peripheral surface of the piston, using a blade in said screen printing unit to press the screen printing stencil against the cylindrical peripheral surface of the piston, and the coating compound through said printing stencil to print the coating compound on the pistons, wherein two or more coatings of different thicknesses are applied to said piston, one after the other at different positions on the cylindrical periphery of the piston in the same process sequence.

* * * * *